United States Patent [19]

Winkelmann et al.

[11] Patent Number: 4,664,286

[45] Date of Patent: May 12, 1987

[54] DEVICE FOR THE PROTECTION OF CYLINDER VALVE FOR STEEL CYLINDERS

[75] Inventors: Hans-Joachim Winkelmann, Altleiningen; Wolfgang Busch, Oberhaching, both of Fed. Rep. of Germany

[73] Assignee: Messer. Griesheim, GmbH, Fed. Rep. of Germany

[21] Appl. No.: 821,440

[22] Filed: Jan. 22, 1986

[30] Foreign Application Priority Data

Jan. 24, 1985 [DE] Fed. Rep. of Germany ..... 3502232

[51] Int. Cl.[4] ..... B65D 25/00; B65D 25/28

[52] U.S. Cl. ..... 220/85 P; 137/382

[58] Field of Search ..... 220/85 P; 137/382

[56] References Cited

U.S. PATENT DOCUMENTS

| | | | |
|---|---|---|---|
| 2,234,458 | 3/1941 | Underhill | 220/85 P |
| 3,648,885 | 2/1972 | Kitsuda | 220/85 P |
| 4,521,676 | 6/1985 | Poulsen | 220/85 P |

FOREIGN PATENT DOCUMENTS

| | | | |
|---|---|---|---|
| 637667 | 5/1928 | France | 220/85 P |
| 68377 | 6/1951 | Netherlands | 220/85 P |
| 1529293 | 10/1978 | United Kingdom | 137/382 |

*Primary Examiner*—George E. Lowrance

*Attorney, Agent, or Firm*—Harold Pezzner

[57] ABSTRACT

A device for protecting the gas cylinder valve of a steel cylinder has a neck ring for screwing on the protective device. The protective device is in the form of a clamp collar having a protective strap which surrounds the gas cylinder valve.

2 Claims, 3 Drawing Figures

DEVICE FOR THE PROTECTION OF CYLINDER VALVE FOR STEEL CYLINDERS

BACKGROUND OF THE INVENTION

The invention is concerned with a device for protecting the gas cylinder valves of steel cylinders which are equipped with a threaded neck ring screwing on the protective device.

Since decades, one has used a bell shaped protective cap for the protection of gas valves of steel cylinders which is screwed onto the neck ring and which completely shields the valve from the environment. The neck ring itself is secured in the opening of the steel cylinder. The gas cylinder valve is screwed into it. These bell shaped protective caps, while they provide complete protection for the gas cylinder valve, in practice, they have a number of disadvantages, especially during the discharge of gas. One of the most important disadvantages of the protective cap consists therein that, in the case of a corroded neck thread, it no longer provides any protection but can even represent a source of danger. It occurs repeatedly with corroded neck threads, especially during manual transport, that the protective caps slip off and accidents are caused as a result. A further disadvantage of the protective caps consists therein that they must be removed for the discharge of gas. As a result, the gas cylinder valve is not protected during the discharge. Aside from this, the removed protective caps are often lost, especially on construction sites. To replace them then becomes expensive. Above all, on construction sites, the protective caps pose the danger that they are often unscrewed with tools that are not designed for such a purpose.

SUMMARY OF THE INVENTION

The object of the invention is to provide a device for protecting the cylinder valve of gas cylinders which is secure even with a corroded neck thread and which permits an all together simpler and easier handling of the cylinder during transport and discharge.

The clamp collar contains, in known fashion, a slit which can be bridged and narrowed by a screw connection. The clamp collar which is screwed onto the neck ring is, as a result, form-fitting by way of the screw connection as well as firmly attached to the steel cylinder in a tightly locking grip by means of the clamp collar.

In the case of an intact neck thread, each of these connections provides a secure attachment. If the form-fitting connection fails due to a corroded neck thread, a secure attachment between the steel cylinder and the protective device is still provided by the clamp collar. The slippage of the protective device, for example during manual transport of the cylinder, is definitely impossible. Even steel cylinders with a corroded neck thread can be safely handled using the inventive protective device. An additional advantage of the invention's device can be seen in that the gas cylinder valve remains protected during the discharge of gas since the protective device does not have to be removed during the discharge of gas. Since the protective device remains screwed on during the discharge of gas, there is not a great possibility the neck thread corrodes. On the other hand, the corroded neck threads can be reused without concern; thus no expensive replacement of neck rings is needed. The loss of the protective device, for example on construction sites, and the thus related transport of steel cylinders with unprotected valves is no longer possible. A further advantage of the invention's protective device is that a secure crane transport is possible for the first time in the practical use of gas by engaging the protective strap with the crane hook. The uppermost region of the protective strap is advantageously designed as a spherical cup. As a result, the steel cylinder can be easily guided when rolled and affords a firm gripping opportunity to to user.

THE DRAWINGS

DETAILED DESCRIPTION

Figure 1:
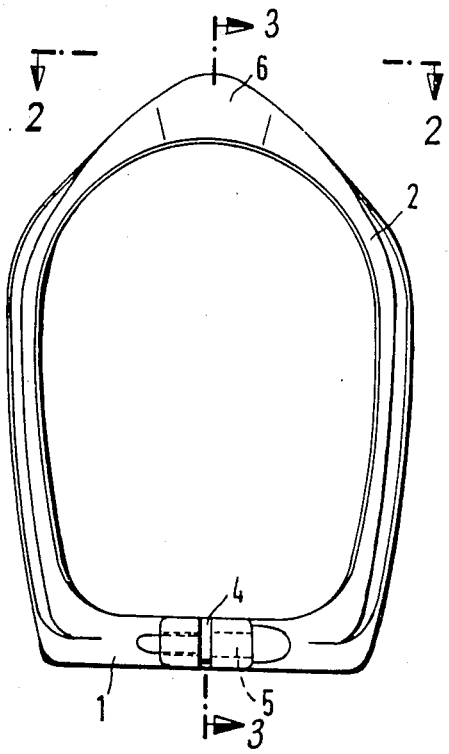
FIG. 1 shows the front view of a protective device according to the invention.
Figure 2:
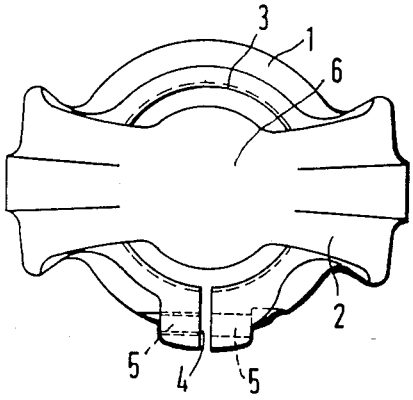
FIG. 2 shows a top view of the protective device along the line A—A in FIG. 1.
Figure 3:
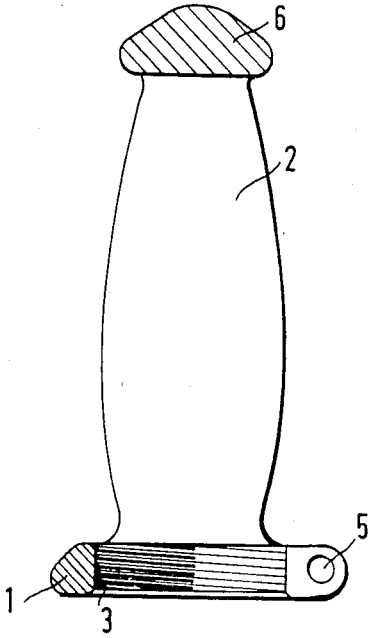
FIG. 3 shows a cross-section of the protective device through the line B-8 in FIG. 1.

The protective device illustrated in FIGS. 1 to 3 consists essentially of the clamp collar 1 and of the protective strap 2 which are designed as one piece castings. The clamp collar 1 is equipped with the known neck thread 3 so that it can be screwed onto the neck ring of the steel cylinder. The clamp collar 1 is split at one point in its circumference by a slit 4. Both ends of the clamp collar 1 have openings 5 for the purpose of taking up a screw which squeezes the ends of the clamp collar 1 together and thus narrows the slit 4. As a result, a connection between the clamp collar 1 and the neck ring is produced which is so powerful that the protective device sits securely on the neck ring regardless of the condition of the thread of the neck ring.

The highest region of the protective strap 2 is designed as a spherical cup 6. This is advantageous for the manual transport of the cylinder because the steel cylinder can be easily guided by the spherical cup 6. The spherical cup 6 the protective strap 2 simultaneously give the user the ability of getting a firm grip. The protective strap 2 is made large enough so that enough room remains above the gas valve in order to engage a crane hook in the protective device. The invention's protective device does not have to always be shown as being of a cast construction even if this is, as a rule, the most advantageous as, for example, malleable cast iron, cast steel and cast iron. Welded or assembled constructions with which, for example, the the protective strap is bolted together with the clamp collar are likewise possible.

What is claimed is:

1. In a device for the protection of the gas cylinder valve of a steel cylinder, in combination therewith, a gas cylinder made of steel, said cylinder having a neck ring for screwing on the protective device, the improvement being in that said protective device is designed as a clamp collar having a protective strap which surrounds said gas cylinder valve, said protective strap being designed in its uppermost region above said gas cylinder valve as a spherical cup, and said clamp collar and said protective strap and said spherical cup are unitary and formed from a one piece casting.

2. Device according to claim 1, characterized therein that said clamp collar is screwed onto said neck ring, said protective strap comprising means for engagement with a crane hook, and said spherical cup comprising means to facilitate said steel cylinder being easily guided when rolled and to provide a gripping means for the user.

* * * * *